US005118084A

United States Patent [19]

Paulus et al.

[11] Patent Number: 5,118,084

[45] Date of Patent: Jun. 2, 1992

[54] APPARATUS FOR CONTROLLED ADJUSTMENT OF A STOPPER OF A DISTRIBUTOR CHANNEL OR THE LIKE IN A CONTINOUS CASTING PLANT

[75] Inventors: Friedhelm Paulus, Hürtgenwald; Josef Lothmann, Langerwehe; Wolfgang Schönbrenner, Kreuzau, all of Fed. Rep. of Germany

[73] Assignee: Zimmermann & Jansen GmbH, Duren, Fed. Rep. of Germany

[21] Appl. No.: 648,724

[22] Filed: Jan. 31, 1991

[30] Foreign Application Priority Data

Jan. 31, 1990 [DE] Fed. Rep. of Germany ..... 4002820
Feb. 14, 1990 [DE] Fed. Rep. of Germany ..... 4004547
Oct. 9, 1990 [EP] European Pat. Off. ..... 9011934.2

[51] Int. Cl.[5] ..... B22D 7/00
[52] U.S. Cl. ..... 266/236; 266/271
[58] Field of Search ..... 266/236, 271; 222/602

[56] References Cited

U.S. PATENT DOCUMENTS 2,076,475 4/1937 Matta ..... 222/602
2,223,062 11/1940 Edgar Jr. ..... 222/602

*Primary Examiner*—Scott Kastler
*Attorney, Agent, or Firm*—Lorusso & Loud

[57] ABSTRACT

An apparatus for controlled adjustment of a stopper of a distributor channel or metallurgical vessel in a continuous casting plant (for billets or ingots), the stopper being connected to a crosstie or stopper rod disposed above the distributor channel or metallurgical vessel, and the crosstie or stopper rod itself being connected to a support bar which is movable up and down in a vertical guide means. The vertical guide means of the support bar is a roller guide means comprising support rollers or support balls which are clamped without clearance between the support bar and an outer housing.

33 Claims, 10 Drawing Sheets

1
19
31
16
26
24
25
32
20
34
35
37
36
40
38
29
27
39
41
30
28
T
33
T
P
T

APPARATUS FOR CONTROLLED ADJUSTMENT OF A STOPPER OF A DISTRIBUTOR CHANNEL OR THE LIKE IN A CONTINOUS CASTING PLANT

The invention relates to an apparatus for controlled adjustment of a stopper of a distributor channel or metallurgical vessel in a continuous casting plant (for billets, ingots, or slabs), which stopper is connected to a crosstie or stopper rod disposed above the distributor channel or metallurgical vessel, the crosstie or stopper rod itself being connected to a support bar which is movable up and down in a vertical guide means.

Apparatus or stopper lifting devices of this kind are characterized by a wide range of tolerances and correspondingly great mechanical play with the result that there is little precision in stopper motion so that constant readjustment of the stopper position is needed if a certain given casting rate is to be achieved. The problem in question becomes particularly acute if the dimensions to be cast are $\leqq 160$ mm$^2$. With these sizes, tolerances in the stopper mechanism are highly undesirable.

It is the object of the instant invention to provide a stopper mechanism practically without any tolerance so that the problems mentioned can no longer occur. At the same time, the costs of manufacturing and maintenance of such a stopper mechanism are to be reduced considerably, at least are not to surpass the expenditure at present involved in this respect.

This object is met, in accordance with the invention, by the characterizing features of the invention. The provision of support rollers or balls, firmly clamped between the support bar and an outer guide housing, establishes a kind of vertical guidance of the support bar for the stopper rod practically without friction and clearance. That provides a correspondingly high degree of precision of the stopper mechanism according to the invention and, as a consequence, an adjustment just as precise of the melt to be poured.

Advantageous structural details and further developments of the apparatus are taken to ensure permanent safe operation.

Preferably, the guide bar comprises a part of square section surrounded by a corresponding square guide housing which can be opened for assembly, disassembly, and maintenance. Measures are taken to assure the clamping without clearance of the support rollers between the support bar and the guide housing.

Measures are also taken to promote the object to be met in respect of simple mounting and demounting of the stopper drive means associated with the vertical guide means according to the invention. The drive means, moreover, is designed so that the power transmission takes place without play.

BRIEF DESCRIPTION OF THE DRAWINGS

The invention will be described further, by way of example, with reference to the accompanying draiwngs, in which:

As shown in FIGS. 1 and 2, the vertical guide means associated with a square section part 1 of a support bar which is movable up and down and carries a stopper rod 22 (not shown specifically in FIGS. 1 and 2) is composed of two U-sections 2 and 3 firmly welded together at right angles. U-sections 7 are pivotably connected by double hinges 6 to the free longitudinal edges or legs not welded together of the first U-sections so that they can be swung into a position in which they form a passage complementary to the square section part 1 together with the U-sections 2 and 3 which are firmly welded together. An L-section 4 is used to weld together the two U-sections 2 and 3 in question in the area of the abutting longitudinal edges of the two U-sections 2 and 3. The hinge connection mentioned of the U-sections 7 makes it possible to open the vertical guide means of the support bar without any greater expenditure for assembly and disassembly.

Moreover, the vertical guide means mentioned is characterized by support rollers 10 which are clamped between the square section part 1 of the support bar and the guide housing defined by the above mentioned U-sections 2, 3, and 7. As shown in FIGS. 2 and 3, the support rollers 10 each are retained by flexible support roller bands 11. Each support roller band 11 is secured to the support bar or its square section part 1, on the one hand, and to the associated support surface of the guide housing 2,3,7, on the other hand, and, at the same time, forms a support roller pocket (cf. FIGS. 2 and 3*a*). The support roller bands 11 safely hold the otherwise loosely arranged support rollers 10 between the square section part 1 and the guide housing 2,3,7. As may be taken from FIGS. 1 and 2, the square section part 1 of the support bar is supported by the support rollers 10 at all four sides with respect to the guide housing 2,3,7. Two axially spaced support rollers 10 are arranged at each side, in the diametrical end portion of the guide housing 2,3,7. As the support roller bands 11 are fixed also at the pivotably supported part 7 of the guide housing, the latter can be opened in part only if the support roller bands are not dismantled at this part. The full opening of the guide housing requires the support roller bands 11 to be loosened or removed from the pivotable housing part 7. Even though this does not involve much expenditure, it can be avoided by the measures shown in FIGS. 5 and 6.

In FIGS. *3a,3b* the support roller bands 11 show a kind of perforation which preferably cooperates with circumferential surfaces of the support rollers 10 having completementary profiles so as to avoid relative motion between the support rollers 10 and the support roller bands 11 coordinated with them.

As an alternative, shown in FIG. *3c*, the circumferential surfaces of the support rollers 10 each may be toothed in the direction of the longitudinal axis of the support roller and cooperate with a complementary toothing formed at the square section part 1 of the support bar, on the one hand, and the respective associated inside of the guide housing 2,3,7, on the other hand.

Figure 2:
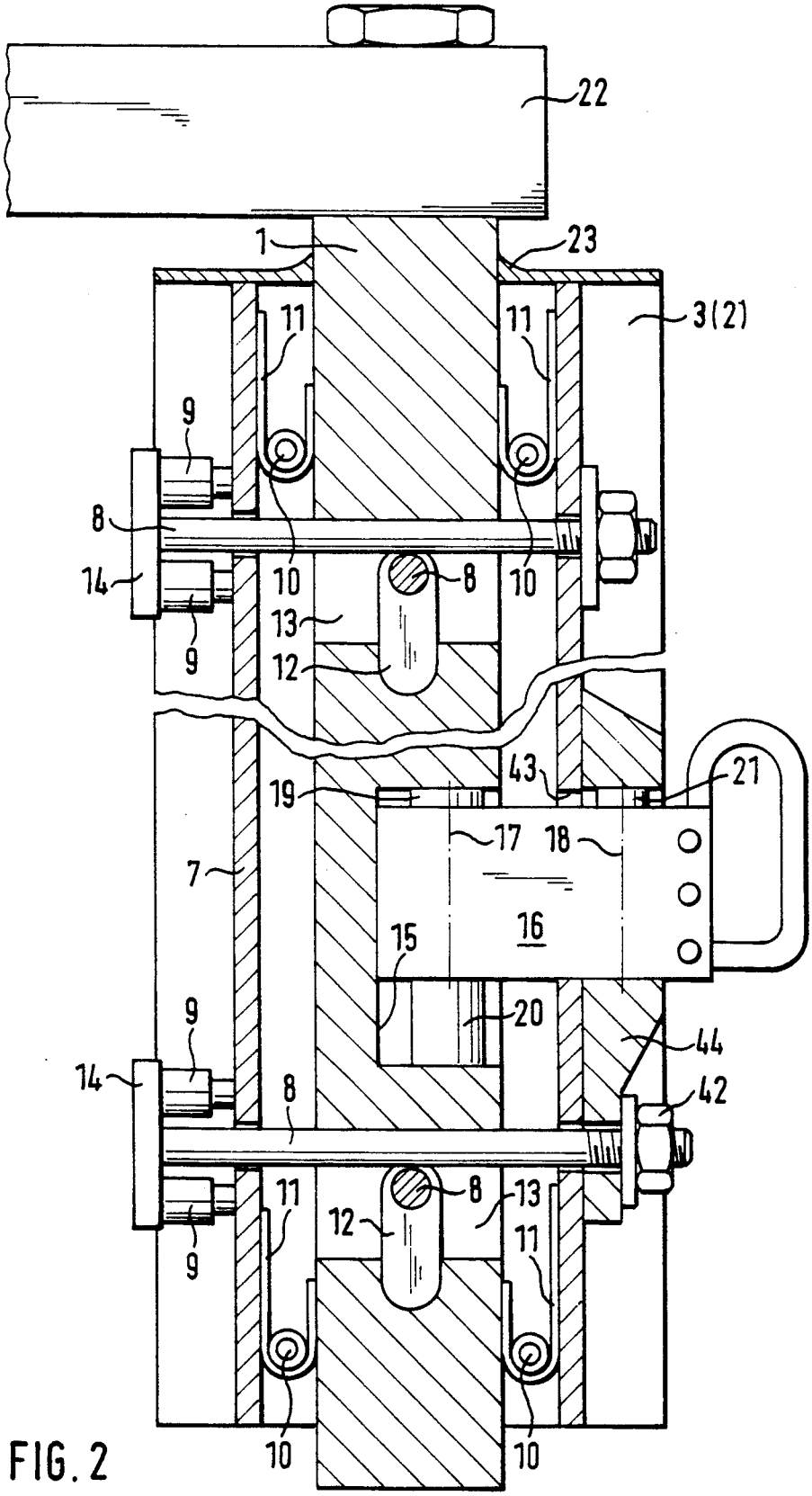
FIG. 2 is a longitudinal sectional elevation of the vertical guide means shown in FIG. 1 (with drive)
Figure 3A:
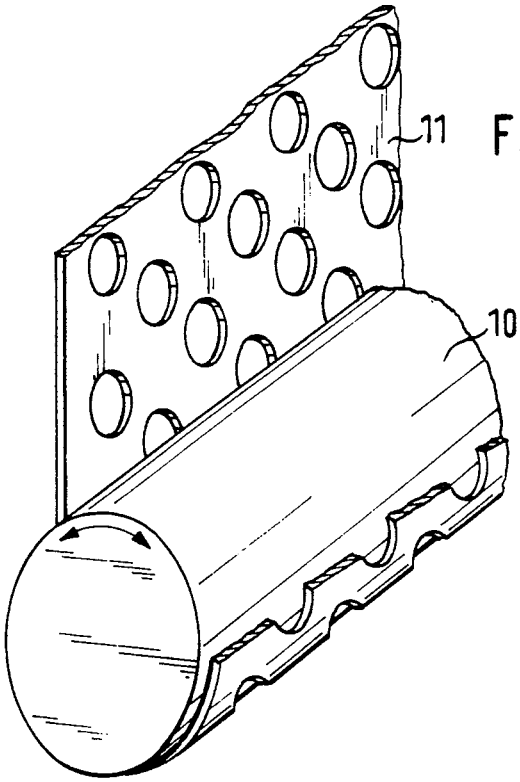
FIGS. 3*a*–3*c* are perspective views of part of the vertical guide means according to the invention, on an enlarged scale.
Figure 3B:
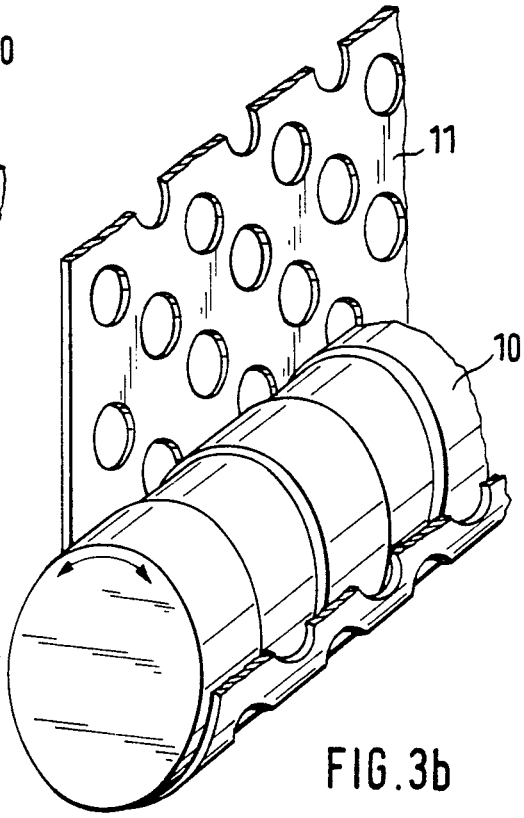
Figure 3C:
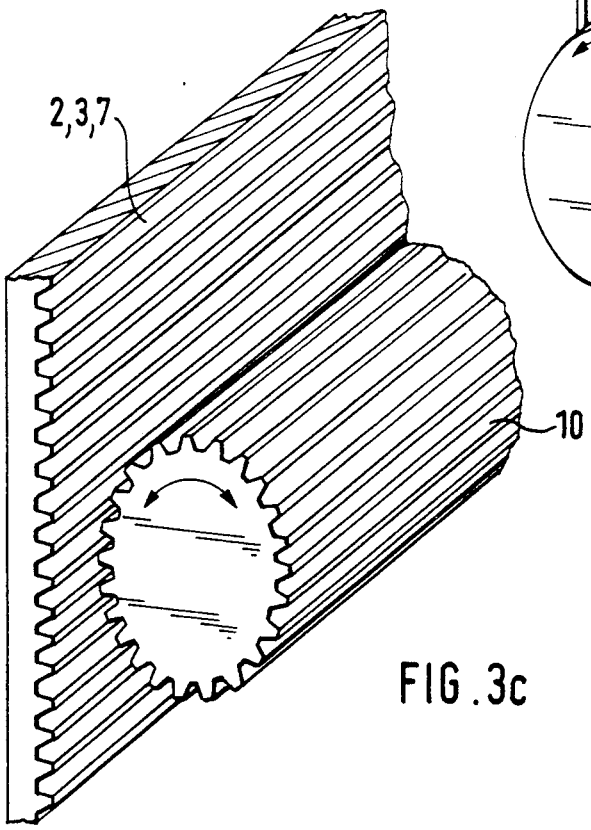

According to FIG. 2 the square section part 1 of the support bar 5 has recesses, four of which are designed as oblong holes 12,13 disposed crosswise and axially spaced, in other words, so as to intersect each other at right angles, while penetrating each other. A total of four tie rods 8, each provided with a collar 14 at the end, pass through these oblong holes 12,13. The tie rods 8 also extend through the respective opposite sides of the guide housing or the opposed webs of the U-sections 2,7, and 3, 7, respectively, which constitute the housing. The ends of the tie rods 8 opposite the collar 14 each are formed with a thread on which a nut 42 can be threaded The guide housing 2,3,7 is held together by the tie rods 8, with corresponding clamping of the support rollers 10. The suitable bias is obtained against the effect of spring elements, especially thermodynamic spring elements according to DE-B-24 06 006, disposed between the collar 14 of each tie rod 8 and the corresponding side of the guide housing 2,3,7. The above mentioned spring elements 9 preferably each are effective at the pivotably supported U-sections 7, this being so purely for reasons of assembly The necessary clamping of the support rollers 10 is adjustable by the tie rods 8 and the above mentioned spring elements. At the same time, this provides vertical guidance without clearance of the support bar and thus of the stopper arranged at the stopper rod 22.

The support rollers 10 provide multifunctional support of the square section part 1. During vertical movement of the support bar or square section part 1 they carry out pure rolling motion. Thus the vertical guidance described is practically without friction. Accordingly, there is little wear and, therefore, little maintenance expenditure.

The support roller bands 11 mentioned above preferably are made of thin sheet metal having a thickness of from 0.3 to 0.5 mm. The preferred material for the bands in question are steel alloys as follows: X 6 Cr NiTi1810=1.4541 or X 6 Cr NiMoTi 17 122=1.4571. As explained above, the support roller bands 11 serve for positioning the support rollers 10 between the square section part 1 and the outer guide housing 2,3,7. That is true particularly with regard to the assembly.

The above mentioned perforation of the support roller bands 11 preferably is characterized by holes having a diameter of approximately 10 mm. This measure is favorable also as regards any possible dirt which may fall out. A complementary profile at the circumferential surface of the support rollers 10 need not necessarily be provided, yet it is advantageous, as explained above with reference to the avoidance of slip.

Figure 4:
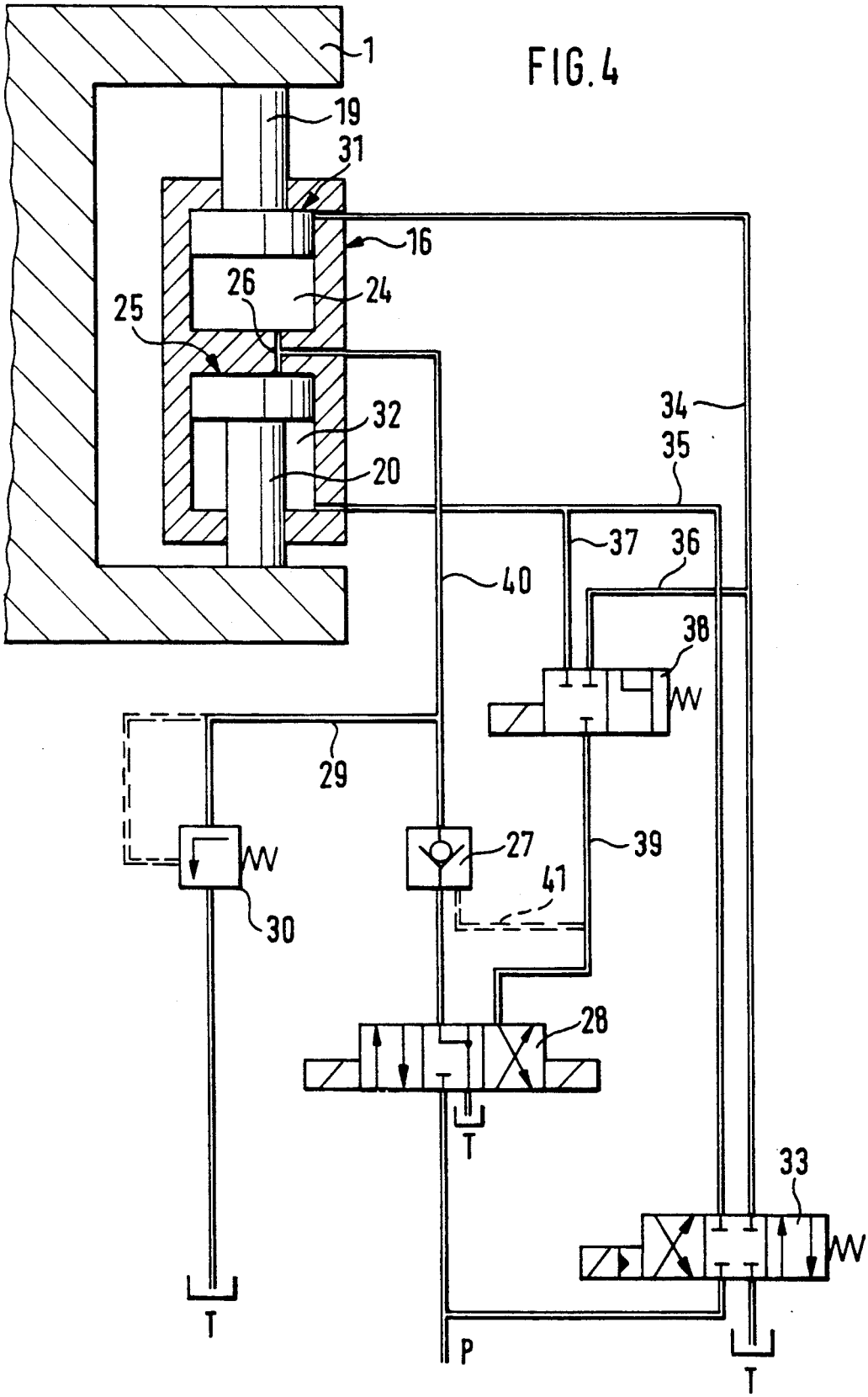
FIG. 4 shows the hydraulic circuit of a preferred stopper drive means associated with the vertical guide means according to the invention in accordance with FIG. 2.

The fifth recess 15 in the square section part 1 is destined for the lateral insertion of a block piston and cylinder unit 16 by which the support bar is movable back and forth as well as up and down. The piston and cylinder unit 16 mentioned thus can be supported at the guide housing 2,3,7, on the one hand, and at the support bar, namely the square section part 1 thereof, on the other hand. It comprises two piston rods 19,20 adapted to be extended coaxially and diametrically out of the cylinder casing and a third piston rod 21 adapted to be extended out of the casing, the first two piston rods 19,20 engaging square section part 1 or the support bar within the lateral recess 15 for moving it up and down, while the latter piston rod 21 accomplishes the fixing of the piston and cylinder unit 16 at the stationary guide housing 2,3,7, or the guide housing secured to the distributor channel. The latter piston rod 21 is effective laterally spaced from the two piston rods 19,20 mentioned first. It also extends parallel to them (cf. central axes 17,18 of the cylinder or piston rods in FIG. 2). A passage 43 corresponding to the lateral recess 15 formed in the square section part 1 of the support bar is associated with the same. Through this passage the piston and cylinder unit 16 mentioned above can be introduced into the lateral recess 15 of the square section part 1 of the support bar, with the two piston rods 19, 20 leading the way. Upon insertion of the piston and cylinder unit 16 in the above mentioned manner, all three pistons and consequently also the piston rods 19,20,21 are extended. The diametrically effective piston rods 19,20 rest on the upper and lower sides of the lateral recess 15 in the square section part 1, while the piston rod 21 located further outside rests on the guide housing or a support block 44 connected to the same, with corresponding fixation of the piston and cylinder unit 16 at the guide housing 2,3,7. On the occasion of a stroke command, the hydraulics associated with the piston rods 19.20 which engage the square section part 1 moves these piston rods in opposite directions under permanent "excess force" in the direction of "extension", i.e. upwardly in FIG. 1, accompanied by corresponding opening of the stopper closure. The hydraulic circuit according to FIG. 4 illustrates the mode of operation of the hydraulics acting on the square section part 1. In that case the power support of the piston and cylinder unit 16 at the outer guide housing 7 is not shown for reasons of clarity.

In principle, the diametrically effective piston rods 19, 20 or their associated pistons each are pressurized in operation, either the upper or the lower piston being under excess pressure as compared to the diametrically effective piston, depending on the desired direction of movement of the support bar and thus of the stopper. In accordance with FIG. 4, the cylinder chambers 24,25 associated with the diametrically effective pistons and each being free of a piston rod are in fluid communication with each other (connecting line 26). This fluid connection 26 serves to build up pressure which moves the two pistons apart. In practice this pressure is approximately from 180 to 250 bars. Because of this high pressure, the two diametrically acting pistons practically are interconnected firmly. The fluid connection 26 mentioned can be connected by way of a check valve 27 which is openable only toward this connection and through a ¾ way valve 28 either to the pump "P" or to the tank "T" of the hydraulics, this connection being established through a conduit 40. A conduit 29 branches off between the check valve 27 and the above mentioned fluid connection 26 and leads to the tank "T". An adjustable pressure relief valve 30 is arranged in conduit 29. The cylinder chambers 31,32 through which the diametrically effective piston rods 19,20 pass each are adapted to be connected through a ¾ way valve 33 alternatively to the pump "P" or to the tank "T", with respective conduits 36,37 branching off from the corresponding connecting lines 34,35 toward a pilot valve 38 by which either both connecting lines 34,35 or none is adapted to be connected through a conduit 39 to the ¾ way valve 28 to which the fluid connection 26 between the two cylinder chambers 24,25 without piston rods is connected as well. The check valve 27 arranged in the latter connection 40 is adapted to be unlocked through a pressure line 41 which branches off from the conduit 39 linking the pilot valve 38 to the ¾ way valve 28. That is accompanied by a corresponding reduction of the piston spreading pressure in the fluid connection 26 between the two cylinder chambers 24, 25 which are free of piston rods, provided the ¾ way valve 28 at the same time is located in the right hand relief position of FIG. 4. In this position, the conduit 40 is connected to the tank "T". The conduit 39 and thus also the pressure line 41 communicate with the pump "P" in this position of valve 28 so that the check valve 27 is unlocked, thereby diminishing the pressure in the fluid connection 26 through conduit 40 to the tank "T" by means of the check valve 27. Pressure build-up in the fluid connection 26 is realized in the opposite order, namely with the ¾ way valve 28 in the left position in FIG. 4. In this position, the pump "P" is connected through the check valve 27 and the conduit 40 to the fluid connection 26. The tank "T" communicates through conduit 39 with pilot valve 38 which is located in the so-called "h" position, i.e. in the right position in FIG. 4, both during pressure reduction and pressure build-up in the fluid connection 26. In this position, the conduit 39 communicates with connecting lines 34,35 and 36,37, respectively. Upon build-up of the desired high pressure in the fluid connection 26, both the pilot valve 38 and the ¾ way valve 28 are moved into the positions shown in FIG. 4. Conduit 39 is pressureless in these positions. The check valve 27 is active so that the pressure built up in the fluid connection 26 is maintained. This pressure is adjusted by the pressure relief valve 30. The connecting lines 36,35 are uncoupled from the ¾ way valve 28 so that only the ¾ way valve 33 associated directly with the connecting lines 34,35 continues to be effective. The up and down movements of the piston rods 19,20 are effected by means of this valve. All the valves preferably are solenoid controlled.

By virtue of the high pressure established in the fluid connection 26, the two diametrical pistons act like a single piston with two diametrically extending piston rods.

For assembly or disassembly of the piston and cylinder unit 16, the pressure in the fluid connection 26 is diminished in the manner mentioned above. For operation, the pressure buildup in this fluid connection is effected in the manner described, i.e. the piston and cylinder unit 16 is "tensioned" in the manner described. After the "tensioning", valves 28 and 38 are moved into the operative positions in the manner already described, namely as illustrated in FIG. 4, so that only the ¾ way valve 33 will serve to cause the synchronous up and down movements of the piston rods 19,20.

Summing up, it may be said that the system described works practically without any slip and, as a consequence, there is only little wear and correspondingly lower maintenance costs. Furthermore, freedom of clearance is guaranteed. Maintenance is particularly easy because of the double hinge design 6. The same is true of the mounting and dismantling of the whole vertical guide means. Standard steels can be used for all parts. The absence of clearance or tolerance in the vertical guide means is multiaxial. Separate lubrication of the vertical guide means can be dispensed with.

Figure 1:
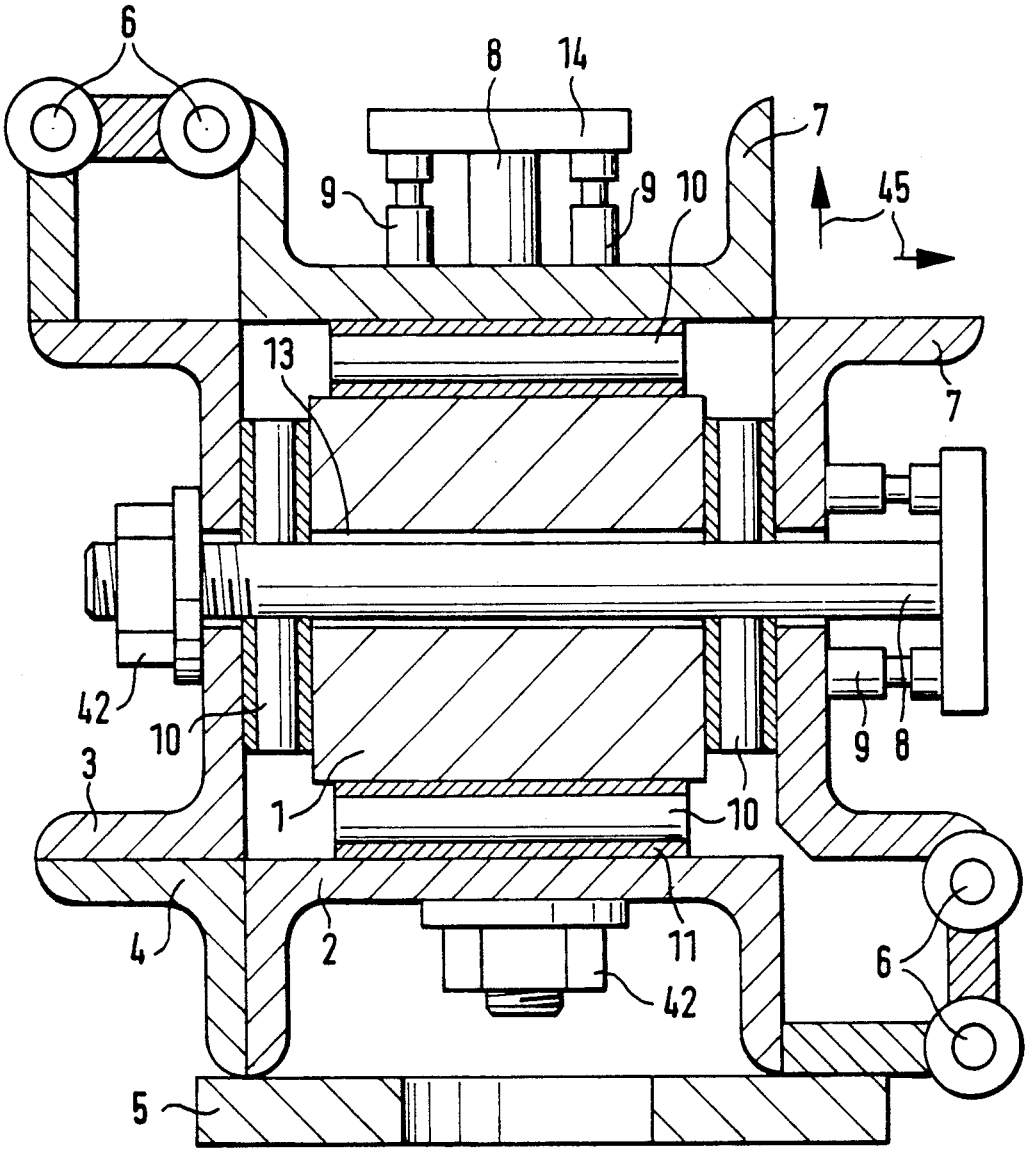
FIG. 1 is a cross sectional elevation of a vertical guide means according to the invention for the support bar of a stopper rod (without drive)

It should be pointed out that in FIG. 1 reference numeral 5 designates part of the distributor channel. Moreover, in FIG. 1 the direction of opening of the U-sections 7 is indicated by the arrows 45.

Figure 5:
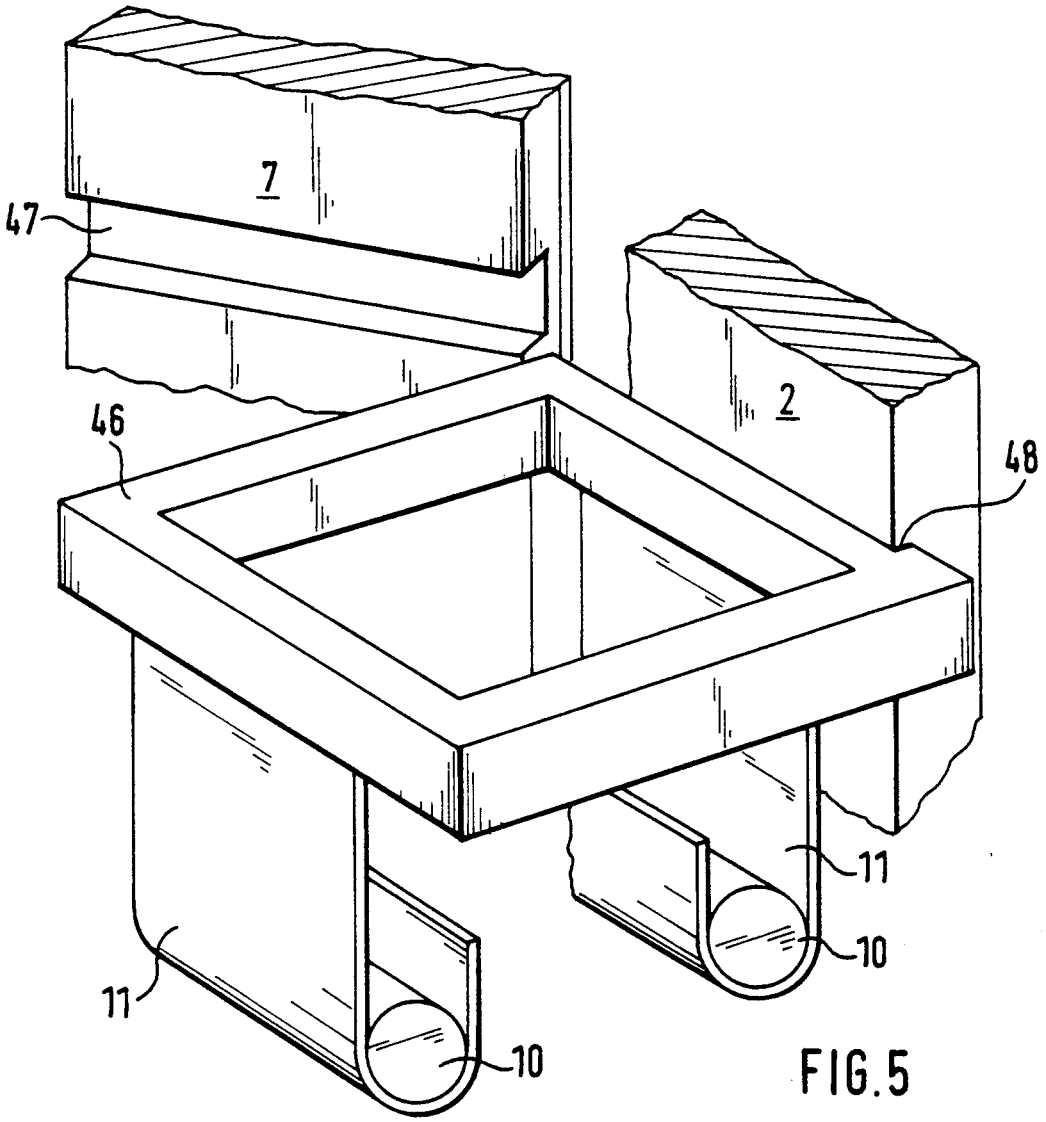
FIG. 5 is a perspective presentation of an alternative way of securing the support roller bands within the vertical guide means of the support bar.
Figure 6:
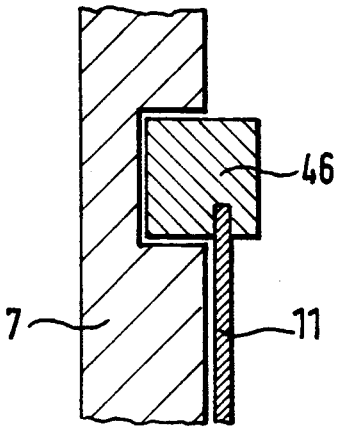
FIG. 6 is a sectional elevation of a detail of the support roller band fixing shown in FIG. 5.

In FIGS. 5 and 6 an alternative way of fixing the support roller bands 11 is shown diagrammatically according to which the support roller bands 11 are fixed at a rectangular frame 46 at the guide housing end. This frame is permanently fixed at the stationary part of the guide housing, i.e. the U-sections 2 and 3, within appropriate horizontal grooves 48, whereby the support roller bands 11 fixed at the frame 46 abut against the inner wall surfaces of the stationary part of the guide housing or U-sections 2 and 3, by their portions facing the guide housing. In corresponding manner also the pivotably supported part of the support bar guide housing, i.e. the pivotably supported U-sections 7 have horizontal grooves 47 at the inside to receive the above mentioned rectangular frame 46 in closed condition of the support bar guide housing (cf. especially FIG. 6). The rectangular frame 46 is adapted to the free cross section of the support bar guide housing, i.e. of square design in the case illustrated.

In the case of the embodiment according to FIGS. 5 and 6 the support bar guide housing 2,3,7 can be opened also without dismantling the support roller bands 11 associated with the pivotable housing member 7.

With the latter embodiment, too, the support roller bands 11 are attached to the square section part 1 of the support bar in the same way as described above.

Besides, it should be noted that in principle also a triangular or hexagonal section is conceivable instead of the square section part 1. In such an event, the guide housing should be of complementary design. In this respect the invention is not to be limited to a square section part of the support bar.

Figure 7:
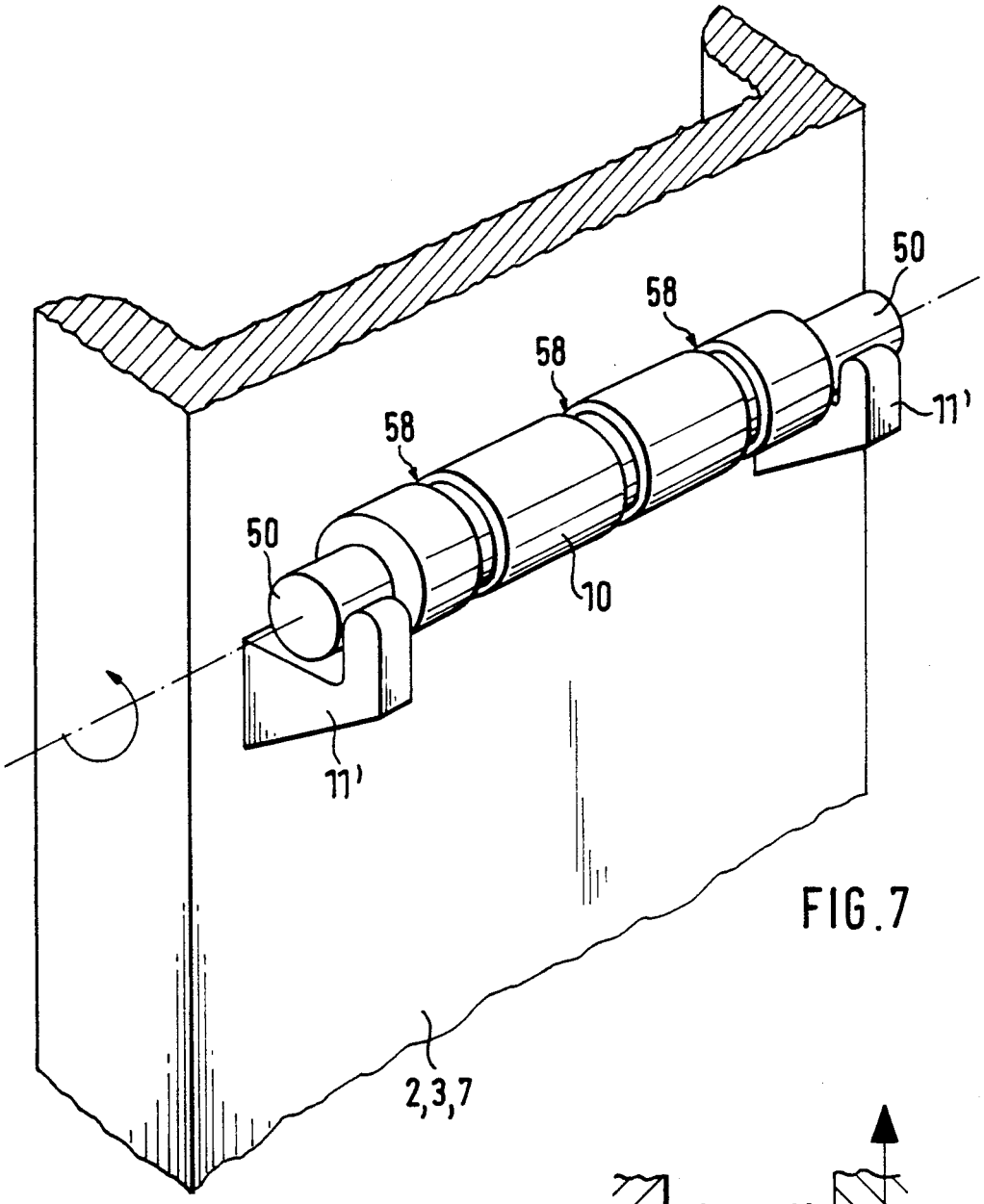
FIGS. 7 and 8 are a perspective part view and side elevation, respectively, of another embodiment of a support roller type vertical guide means.
Figure 8:
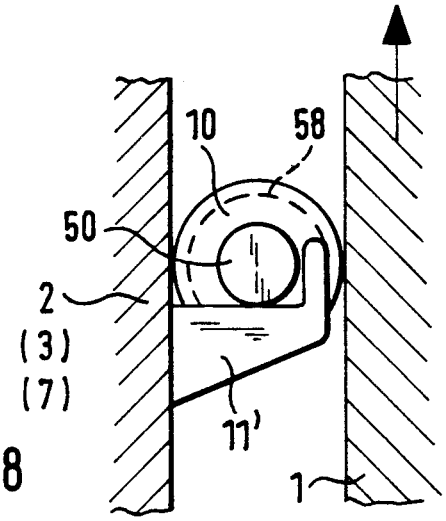

FIGS. 7 and 8 are diagrammatical presentations of another embodiment of a support roller type vertical guide means for the support bar 1. This embodiment is characterized in that stops in the form of projections 11' provided at the inside of the guide housing 2,3,7 and protruding inwardly are associated with each support roller 10. The support roller 10 is adapted to rest on them by its face end portion 50, when the support bar 1 is in lowered position, aligning itself transversely of the support bar 1 or the direction of motion thereof. As the support bar 1 moves upwardly in the direction of the arrow shown in FIG. 8, the support roller 10 rolls along upwardly between the guide housing and the support bar, and it does so without clearance or slip due to the elastic clamping between the guide housing and the support bar. As the support bar 1 moves down into the lowermost position, the end portions 50 enter into engagement with the projecting stops 11'. Thereby it is assured that the support roller 10 always is or remains aligned transversely of the direction of movement of the support bar 1.

The surface of each support roller 10 preferably includes at least one, especially more axially spaced circumferential grooves having a depth of some 2 to 10 mm, especially approximately from 4 to 8 mm, and a width of at least 1.5 to 2 mm. Any dirt accumulating in the gap between the support bar and the guide housing can drop out through these circumferential grooves and be removed easily. The circumferential grooves thus present passages for dirt removal. In FIGS. 7 and 8 the circumferential grooves mentioned are marked by reference numeral 58.

Figure 9:
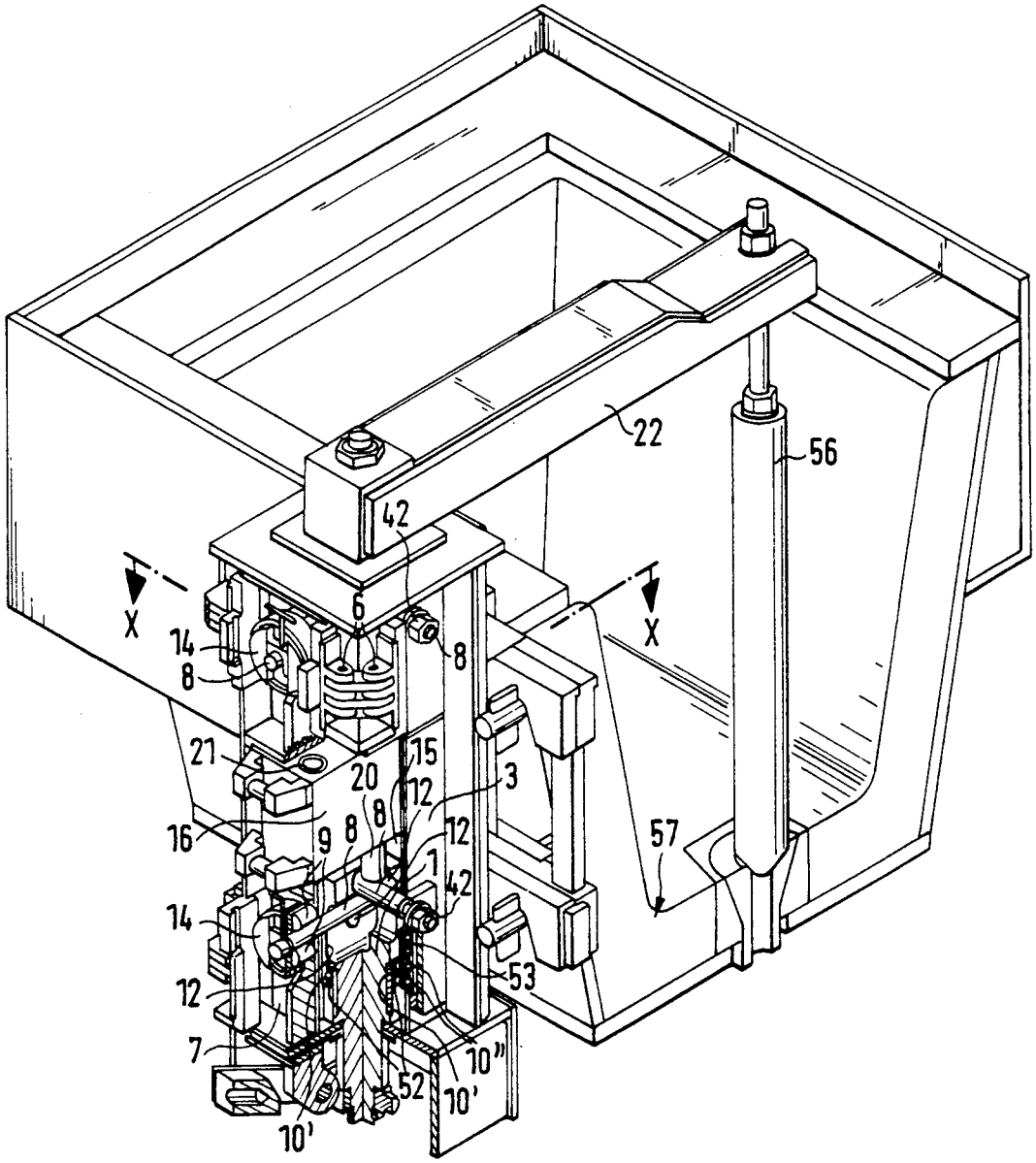
FIG. 9 is a perspective view of an embodiment of the apparatus according to the invention modified still further in its vertical guide means.
Figure 10:
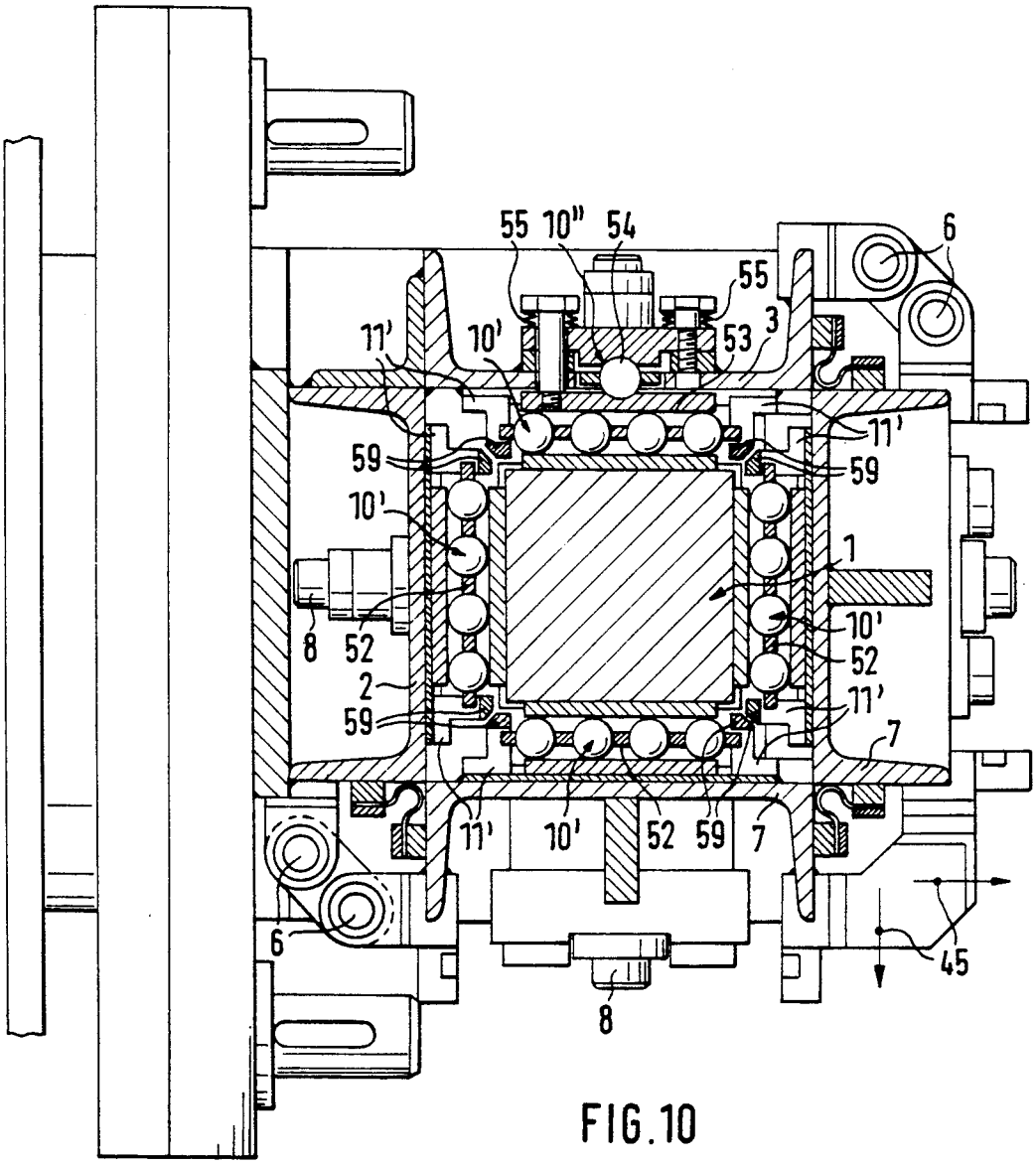
FIG. 10 is a cross section at the level of line X—X of the apparatus shown in FIG. 9.

As regards reliable operation and structural precision, the embodiment according to FIGS. 9 and 10 is of special importance. In that case the rolling body guidance is embodied by commercially available linear ball units 10' extending transversely of the support bar 1 or the direction of motion thereof. Two linear ball units 10' are clamped at each side (four sides) of the mutual support between the support bar 1 and the guide housing 2,3,7. They are axially spaced from each other (in the direction of the support bar or its movement) and under elastic bias furnished by the spring elements 9 described above.

A stop in the form of an L-shaped projection 11' disposed at the inside of the guide housing 2,3,7 enclosing the support bar 1 is associated with each linear ball unit 10'. The respective linear ball unit 10', especially the web-like cage 52 thereof, is adapted to rest on the same when the support bar 1 is in lowered position, the linear ball unit becoming aligned transversely of the support bar or the direction of motion thereof. The function of the stops 11' corresponds to that of stops 11 in FIG. 7. As may be seen especially well in FIG. 10, the clamping and biasing of the support balls 10' without clearance at one of the four sides of the support bar is realized via a bearing surface 53 supported for pivoting movement about a vertical axis 54 and being defined by a plate which is releasably attached to the corresponding side of the guide housing. A linear ball unit 10'' installed vertically forms the pivot support of the bearing surface 53 or bearing surface plate. This structural member, too, is a commercially available product. Specifically, the vertically installed linear ball unit 10'' is arranged between the bearing surface plate 53 and the associated side 3 of the guide housing, the connection between this side of the guide housing and the bearing surface plate 53 being realized by an elastic member, namely Belleville springs 55.

All the other bearing surfaces are firmly mounted at the support bar 1, on the one hand, and at the inside of the guide housing, on the other hand.

The above mentioned pendulum support type design of the one bearing surface or roll-off plate 53 at the side of the guide housing permits tolerances resulting from the manufacture of the guide housing 2,3,7, especially in the rectangular alignment of the respective neighboring sides of the housing to be compensated.

As an alternative of this structure, it would be conceivable to have the supporting and vertical guiding of the support bar 1 inside the guide housing 2,3,7 taken over by diametrically clamped linear ball units 10' whose balls can roll off in respective associated V grooves formed at the outside of the support bar 1, on the one hand, and at the inside of the guide housing 2,3,7, on the other hand. This structure consequently is characterized in that there are only two rolling body guide means which are located diametrically opposite each other between the support bar 1 and the guide housing. The support bar is supported laterally within the guide housing by the above mentioned V grooves in which the support balls are retained. No bearing surface or roll-off plate supported in pendulum fashion is required with this embodiment, even if greater manufacturing tolerances should occur.

The above mentioned ball units 10' and 10'' are available on the market. The rolling body units, namely balls are offered as needed for a particular installation and according to load. They are installed in cages or retainers made either of plastics, aluminum or brass. In the case at issue only aluminum or brass retainers should be suitable. The web-like cages 52 are very favorable because spaces are left free between them on the one hand and the balls and bearing surfaces on the other through which dirt, dust, and the like may fall in the gap between the support bar and the guide housing.

The stops 11' further comprise vertically upstanding prongs 59 in order to prevent side travel of the linear ball units. Each linear ball unit thus is retained between the prongs 59 extending vertically upwards of the stops 11', on the one hand, and the opposed bearing surfaces of the support bar and the guide housing.

FIG. 9 further shows the pouring vessel 57 (distributor channel) and the stopper 56. Thus FIG. 9 provides a good overall view of a preferred embodiment of the apparats according to the invention.

Figure 11:
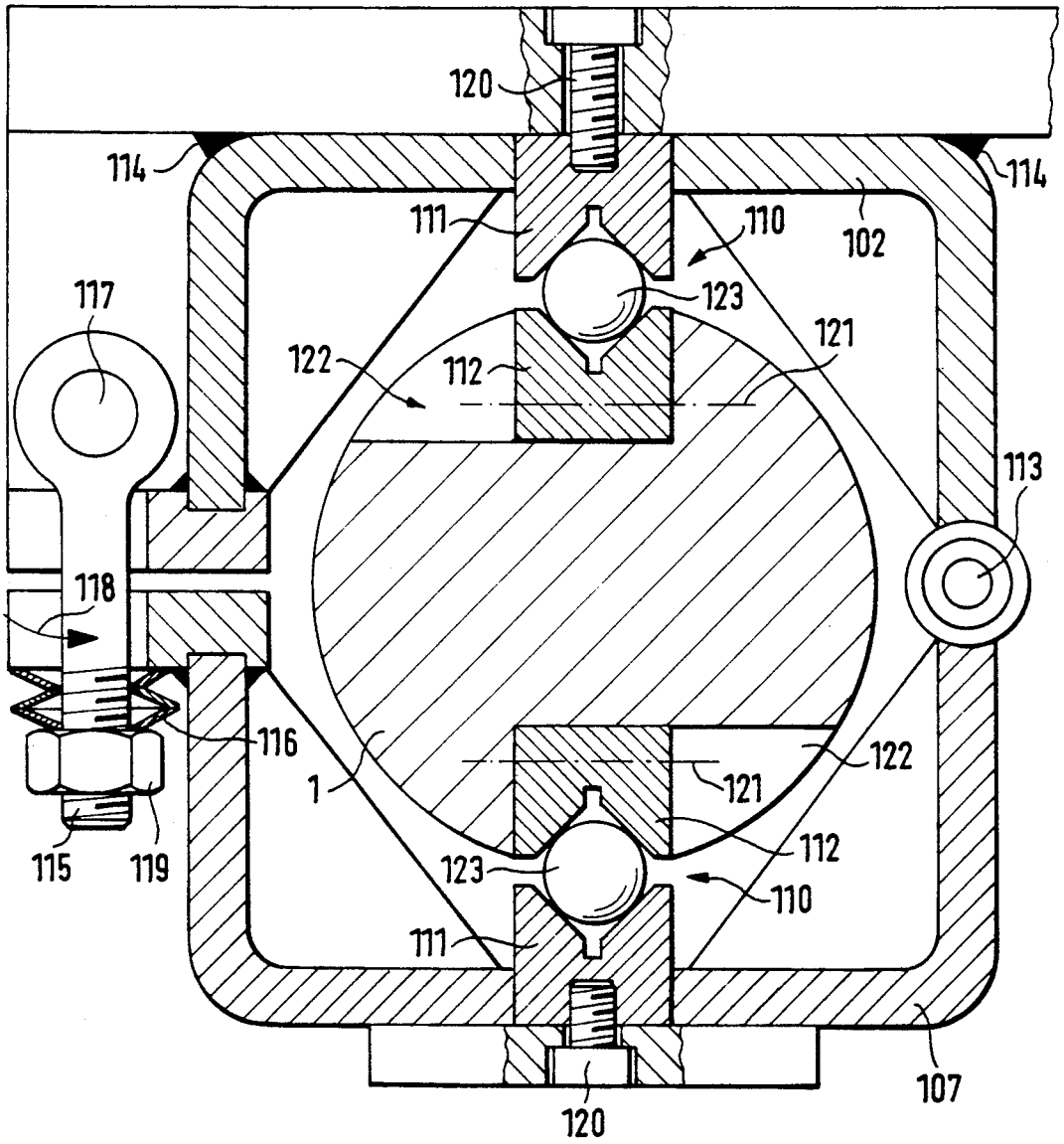
FIG. 11 is a diagrammatic cross sectional view of an embodiment modified still further of a support roller type vertical guide means.

FIG. 11 is a diagrammatic cross sectional view of another embodiment of the supporting and vertical guiding of the support bar 1 within a guide housing 102, 107. This embodiment is characterized by two diametrically clamped linear ball units 110 running in parallel with the support bar 1, the balls being adapted to roll off in respective associated V guides or guide slats 111,112 provided at the support bar 1, on the one hand, and at the inside of the guide housing 102, 107, on the other hand. With the embodiment illustrated, the guide housing is characterized by two U-sections, one U-section 102 being stationarily connected, namely welded (weld seams 114) to the metallurgical vessel, while the other housing section 107 is connected to the first one by a hinge joint 113 extending parallel to the support bar 1 so that the guide housing can be opened. Clamping of the linear ball units 110 is effected by a turnscrew 115 biased by Belleville springs 16 and disposed diametrically opposite the hinge joint 113 with respect to the support bar 1. Preferably the turnscrew 115 is supported at the stationary housing section 102 for pivoting movement about a pivot axis 117 which extends parallel to the support bar 1. All that is needed to close the guide housing 102, 107, therefore, is to pivot the turnscrew 115 about the pivot axis 117 into the position shown in FIG. 11 (see arrow 118) and then fix it in this position by a threaded nut 119 against the bias of the above mentioned Belleville springs 116.

The above mentioned V-groove-like guide slats 111,112 are fixed at the guide housing 102 and 107, respectively, by means of respective bolts 120, on the one hand, and at the support bar 1 by means of bolts 121 not shown in detail. Recesses 122 are provided in the area of the support bar 1 to take up the guide slats 112 so that the guide slats 112, when mounted, will not project beyond the outer periphery of the support bar 1 or will do so only very little.

The embodiment illustrated in FIG. 11 is characterized by the simplest and yet effective design imaginable. True, as compared to the embodiment of FIGS. 9 and 10, the balls 123 of the linear ball units 110 must be somewhat stronger or bigger because of the smaller number of linear ball units. Yet this disadvantage is more than compensated by the otherwise much simpler structure.

Figure 12:
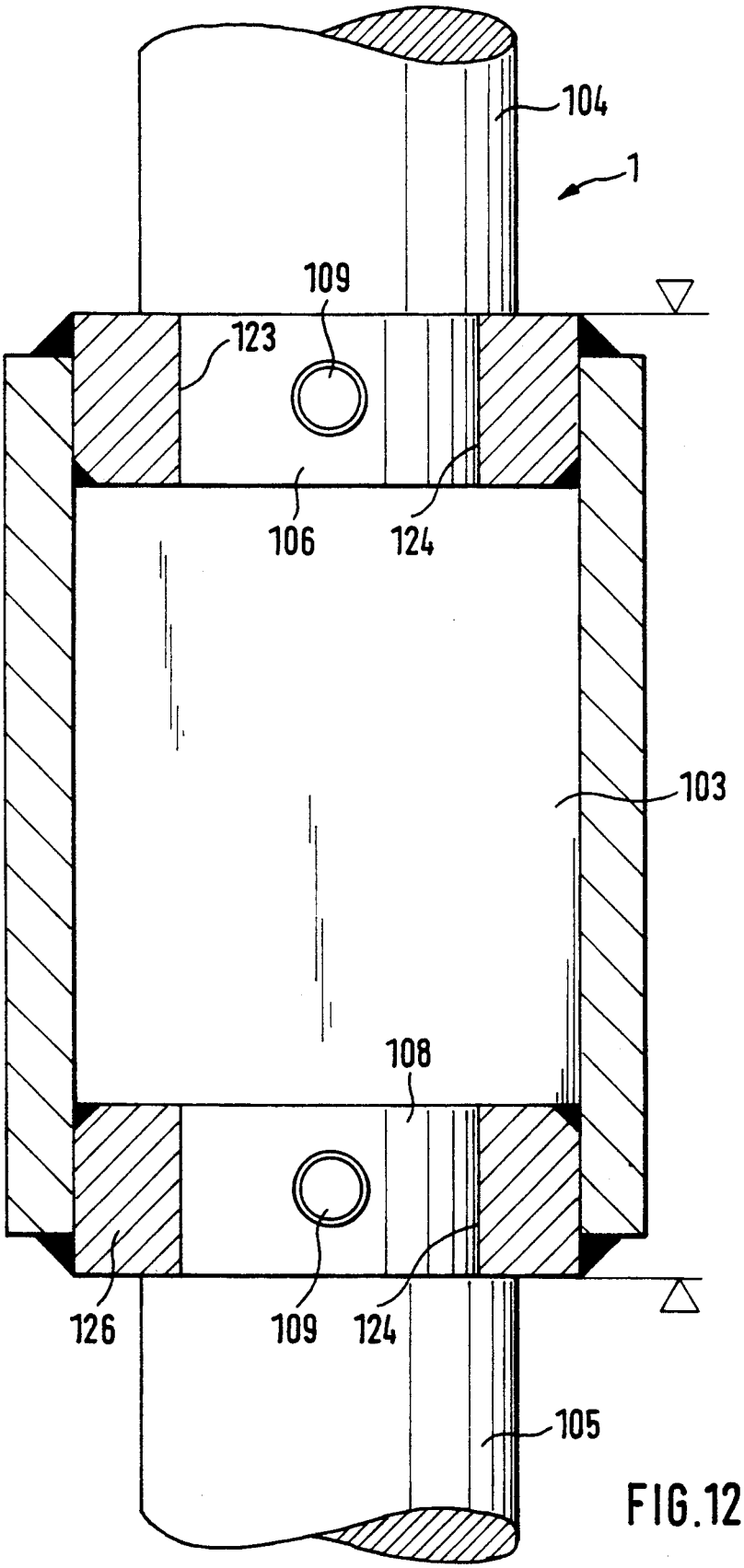
FIG. 12 is a diagrammatic longitudinal sectional view of a modified embodiment of the support bar in the range of action of the vertical drive means.

FIG. 12 shows a modification of the support bar design in the effective range of the block cylinder 16. Accordingly, the support bar 1 comprises a box 103 which is open at one side and inside which the piston and cylinder unit or the block cylinder 16 for movement of the support bar 1 in vertical direction can be positioned. The box 103 is a welded structure, as clearly shown in FIG. 12. On the other hand, the lower end 106 of an upper support bar part 104 and, on the other hand, the upper end 108 of a lower support bar part 105 are connected to the face ends of the box 103, being shrunk into apertures 123, 124 in the face ends of the box 103. Crossbolts 109 take care of additional locking. They extend through the end portions 106,108 and the terminal plates 125,126 at the face ends of the box 103 and are locked in this position in per se known manner. The ends 106, 108 fixed by shrinking of the support bar parts 104 and 105 each have a somewhat smaller diameter than the support bar parts 104 and 105, respectively, so that accurate axial positioning of the support bar parts 104,105 with respect to the box 103 is guaranteed.

What is claimed is:

1. An apparatus for controlled adjustment of a stopper of a distributor channel of metallurgical vessel in a continuous casting plant for billets, ignots, or slabs, which stopper is connected to a crosstie or stopper rod disposed above the distributor channel or metallurgical vessel, the crosstie or stopper rod itself being connected to a support bar which is movable up and down in a vertical guide means, wherein the vertical guide means of the support bar is a rolling body guide means comprising support rollers or support balls which are clamped without clearance between the support bar and an outer guide housing.

2. The apparatus as in claim 1 wherein the support rollers are retained by flexible support roller bands each band being secured to either the support bar or the guide housing either directly or indirectly, the guide housing by way of a fastening frame, each band at the same time forming an upwardly open support roller pocket.

3. The apparatus as in claim 1 wherein the circumferential surfaces of the support rollers each are formed with a profile corresponding to a complementary profile of the support roller bands.

4. The apparatus as in claim 1 wherein the circumferential surfaces of the support rollers each are toothed in the direction of the support rollers or the associated inside of the guide housing.

5. The apparatus as in claim 1 wherein stops comprising projections disposed at the inside of the guide housing enclosing the support bar are associated with each support roller which is adapted to rest on the support roller by its face end portions, when the support bar is in lowered position, becoming aligned transversely of the support bar or the direction of motion thereof.

6. The apparatus as in claim 5 wherein the surface of each support roller comprises at least one circumferential grooves, formed axially spaced from one another, having a depth of some two to ten millimeters (mm), approximately from four to eight mm, and a width of at least one and one-half to two mm.

7. The apparatus as in claim 1 wherein the rolling body guide means is embodied by linear ball units extending transversely of the support bar or the direction of motion thereof, at least two axially spaced linear ball units being clamped at each side of the mutual support between the support bar and the guide housing.

8. The apparatus as in claim 7 wherein a stop comprising a projection disposed at the inside of the guide housing enclosing the support bar is associated with each linear ball unit which is adapted to rest on the the linear ball unit by its web-like cage coming aligned transversely of the support bar or the direction of motion thereof.

9. The apparatus as in claim 7 wherein the supporting and vertical guiding of the support bar within the guide housing are effected by diametrically clamped linear ball units, the balls being adapted to roll off in respective associated V grooves at the outside of either the support bar or the inside of the guide housing.

10. The apparatus as in claim 1 wherein in supporting the support bar at at least three side thereof, the clamping and biasing of the support rollers or support balls without clearance is realized at at last one side by way of a bearing surface which is supported for pivoting about a vertical axis.

11. The apparatus as in claim 10 wherein the pivotable support of the bearing surface for at least one pair of support rollers or linear ball units is embodied by a vertically installed linear ball unit.

12. The apparatus as in claim 11 wherein the vertically installed linear ball unit or support roller is arranged between one side of the guide housing and the associated outer bearing surface or the bearing surface facing the guide housing, the connection between the side of the guide housing and the associated bearing surface being made by an elastic member.

13. The apparatus as in claim 1 wherein the support bar comprises a square section part surrounded by a corresponding square guide housing adapted to be opened.

14. The apparatus as in claim 13 wherein the square guide housing is composed of two corner sections linked in hinge-like manner.

15. The apparatus as in claim 1 wherein tie rods or tension bars extending transversely of the longitudinal axis of the support bar pass through the support bar and the guide housing surrounding the same, the tie rods being arranged crosswise and axially spaced from each other and holding together and bracing the respective opposed sidewalls of the guide housing, with corresponding clamping of the support bar and the guide housing.

16. The apparatus as in claim 15 wherein the bracing of opposed sidewalls of the guide housing is realized against the action of a corresponding elastic member.

17. The apparatus as in claim 15 wherein, in the area of the support bar, the tie rods pass through oblong holes which extend in longitudinal direction of the support bar, the axial dimension of the oblong holes determining the maximum travel of the support bar and thus of the stopper.

18. The apparatus as in claim 1 wherein the gap between the support bar and the guide housing is sealed at least in the upper edge region.

19. The apparatus as in claim 1 wherein the support bar is movable back and forth or up and down by a piston and cylinder unit adapted to be actuated hydraulically, hydropneumatically, or pneumatically.

20. The apparatus as in claim 19 wherein the piston and cylinder unit is adapted to be supported at the guide housing and the support bar.

21. The apparatus as in claim 20 wherein the piston and cylinder unit comprises two piston rods adapted to be extended diametrically out of the cylinder casing and a third piston rod adapted to be extended out of the casing, the first two piston rods engaging the support bar, while the latter piston rod accomplishes the fixing of the piston and cylinder unit at the stationary guide housing.

22. The apparatus as in claim 21 wherein the diametrically effective piston rods engage within a lateral opening of the support bar, and in that the third piston rod extends spaced from the first two piston rods and approximately in parallel with them.

23. The apparatus as claimed in claim 19 wherein the diametrically effective piston rods or their pistons each are pressurized in operation, either the upper or the lower piston being under pressure exceeding the pressure of the diametrically effective piston, depending on the desired direction of movement of the support bar and thus of the stopper.

24. The apparatus as in claim 23 wherein the cylinder chambers associated with the diametrically effective piston and each being free of a piston rod are in fluid communication with each other, the fluid connection serving to build up a pressure which separates the two pistons and the fluid connection being adapted to be connected, through a check valve opening only in the direction toward it and through a $\frac{3}{4}$ way valve either with the pump or with the tank, a conduit which leads to the tank branching off between the check valve and the fluid connection and an adjustable pressure relief valve being arranged in said conduit.

25. The apparatus as in claim 23 wherein the cylinder chambers through which the diametrically effective piston rods pass each are adapted to be connected alternatively to the pump or the tank through a $\frac{3}{4}$ way valve, with respective conduits branching off from the corresponding connecting lines toward a pilot valve by which either both connecting lines or none is adapted to be connected through a conduit to the $\frac{3}{4}$ way valve to which the fluid connection between the two cylinder chambers free of piston rods is connected as well, the check valve disposed in the connection mentioned last being unlockable through a pressure line which branches off from the conduit linking the pilot valve to the $\frac{3}{4}$ way valve mentioned last.

26. The apparatus as in claim 25 wherein the pilot valve is solenoid controlled.

27. The apparatus as in claim 1 wherein the supporting and vertical guiding of the support bar within the guide housing are effected by two diametrically clamped linear ball units which extend parallel to the support bar, the balls being adapted to roll off in respective associated V-groove shaped guide means at the support bar and at the inside of the guide housing.

28. The apparatus as in claim 1 wherein the support bar comprises a box which is open at one side and within which the piston and cylinder unit or the block cylinder for the vertical movement of the support bar is positionable.

29. The apparatus as in claim 28 wherein the lower end of an upper support bar part and the upper end of the lower support bar part are connected by shrinking to the face of the box.

30. The apparatus as in claim 10 wherein the pivotable support of the bearing surface for at least one pair of support rollers or linear ball units is embodied by vertically extending support roller.

31. The apparatus as in claim 1 wherein the gap between the support bar and the guide housing is sealed at least in the upper edge region by a flexible stripper.

32. The apparatus as in claim 28 wherein the lower end of an upper support bar part and the upper end of the lower support bar part are connected by shrinking and locked by a cross-bolt to the face of the box.

33. An apparatus for controlled adjustment of a stopper of a distributor channel of metallurgical vessel in a continuous casting plant for billets, ignots, or slabs, which is a stopper is connected to a crosstie or stopper rod disposed above the distributor channel or metallurgical vessel, the crosstie or stopper rod itself being connected to a support bar which is movable up and down in a vertical guide means, wherein the vertical guide means of the support bar is a rolling body guide means comprising support rollers or support balls which are clamped without clearance between the support bar and an outer guide housing and wherein the support bar is also movable back and forth or up and down by a piston and cylinder unit adapted to be actuated hydraulically, hydropneumatically, or pneumatically, the piston and cylinder unit being adapted to be supported by a guide housing which surrounds the support bar, the piston and cylinder unit comprising two piston rods adapted to be extended diametrically out of the cylinder casing and a third piston rod adapted to be extended out of the casing, the first two piston rods engaging the support bar, while the latter piston rod accomplishes the fixing of the piston and cylinder unit at the stationary guide housing, or the guide housing secured to the distributor channel and the diametrically effective piston rods engage within a lateral opening of the support bar, and in that the third piston rod extends spaced from the first two piston rods and approximately in parallel with them.

* * * * *